United States Patent [19]

Thoma

[11] 4,077,376

[45] Mar. 7, 1978

[54] INJECTION INSTALLATION FOR DIESEL INTERNAL COMBUSTION ENGINE

[75] Inventor: Frank Thoma, Stuttgart, Germany

[73] Assignee: Daimler-Benz Aktiengesellschaft, Germany

[21] Appl. No.: 567,944

[22] Filed: Apr. 14, 1975

[30] Foreign Application Priority Data

Apr. 20, 1974 Germany ..... 2419159

[51] Int. Cl.[2] ..... F02M 55/00

[52] U.S. Cl. ..... 123/139 DP; 123/139 AT; 239/126

[58] Field of Search ..... 123/139 DP, 139 AF, 123/139 AA, 139 R, 139 BF, 139 AT, 139 AK, 139 AZ; 239/126, 127

[56] References Cited

U.S. PATENT DOCUMENTS

| | | | |
|---|---|---|---|
| 1,596,194 | 8/1926 | Lang | 123/139 DP |
| 1,597,317 | 8/1926 | Jorgensen | 123/139 DP |
| 1,613,000 | 1/1927 | Widdowson | 123/139 DP |
| 2,318,449 | 5/1943 | Beeh | 123/139 DP X |
| 2,380,148 | 7/1945 | Camner | 123/139 AT |
| 2,605,141 | 7/1952 | Pyk et al. | 123/139 AT |
| 2,627,254 | 2/1953 | DeJuhasz | 123/32 JV |

*Primary Examiner*—Charles J. Myhre
*Assistant Examiner*—Tony M. Argenbright
*Attorney, Agent, or Firm*—Craig & Antonelli

[57] ABSTRACT

An injection system for a Diesel internal combustion engine which includes an injection pump with injection lines, injection valves with valve needles opening inwardly against spring pressure and leakage oil lines starting from the injection valve; a device consisting of a flow-direction sensor detecting the direction of flow and of a discharge valve is thereby arranged in each injection line, preferably in proximity of the injection valve, which discharges the pump volume of the injection valve resulting at the end of the injection operation into the leakage oil line.

28 Claims, 5 Drawing Figures

INJECTION INSTALLATION FOR DIESEL INTERNAL COMBUSTION ENGINE

The present invention relates to an injection installation for a Diesel internal combustion engine which essentially includes an injection pump with injection lines, injection valves with valve needles or pins opening inwardly against spring pressure and leakage oil lines starting from the injection valves.

With injection systems of this type, the valve needle or pin again moves back toward its seat at the end of the injection operation. It thereby displaces a volume which results from the needle cross section and the needle stroke.

This volume which is pumped by the valve needle with the force of the nozzle spring, is sprayed off in part through the nozzle openings and is pumped in part into the injection line. The volume sprayed off through the nozzle openings leaves only with relatively low velocity. This brings about a lengthening of the injection and a poor atomization so that an unfavorable development of the combustion process results in the engine. The volume pumped into the injection line produces thereat a pressure wave which moves toward the injection pump, is reflected thereat, and moves back toward the injection valve and, under certain circumstances, causes an after-injection at the injection valve. However, an after-injection will also affect unfavorably the combustion process.

The present invention is now concerned with the task to eliminate the described disadvantages. The underlying problems are solved according to the present invention in that an installation consisting of a sensor detecting the direction of flow and of a discharge valve is arranged in each injection line, preferably in proximity of the injection valve, which conducts away into the leakage oil line the pump volume of the injection valve resulting at the end of the injection operation.

The injection period is kept short by the present invention combined with a good atomization of the fuel. An after-injection of the injection valves does not take place. As soon as fuel flows in the direction toward the injection pump, the discharge valve in proximity of the injection valve is opened, and the fuel which flows back is conducted away into a space with low pressure. Since this is the path of least resistance for the volume pumped by the nozzle needle, practically hardly any fuel still flows through the nozzle apertures in the injection valve and into the injection line. The flow direction is thereby determined by the flow direction sensor in proximity of the injection valve which then controls the discharge valve.

The discharge valve may consist advantageously of a valve body closing in the direction toward the injection pump and opening thereby in the direction toward the leakage oil line.

According to another embodiment of the present invention, the flow-direction sensor and the discharge valve may be arranged in parallel to one another. However, it is also possible to combine the flow-direction sensor and the discharge valve into a structural unit. The check valve may thereby be arranged at or in the valve body of the discharge valve. If a throttle is used as sensor for detecting the direction of flow, then the throttle may be provided at the valve body of the discharge valve.

Accordingly, it is an object of the present invention to provide an injection installation for a Diesel internal combustion engine which avoids by simple means the aforementioned shortcomings and drawbacks encountered in the prior art.

Another object of the present invention resides in an injection system for a Diesel internal combustion engine which ensures a short injection period accompanied with good atomization of the fuel.

A further object of the present invention resides in an injection installation for a Diesel internal combustion engine which results in an improved combustion process.

Still a further object of the present invention resides in an injection installation for Diesel internal combustion engines which precludes an after-injection that might unfavorably affect the combustion process.

Another object of the present invention resides in an injection installation for Diesel internal combustion engines which achieves the aforementioned aims and objects by simple means that can be realized with relatively small expenditures.

These and other objects, features and advantages of the present invention will become more apparent from the following description when taken in connection with the accompanying drawing which shows, for purposes of illustration only, several embodiments in accordance with the present invention, and wherein.

Figure 4:
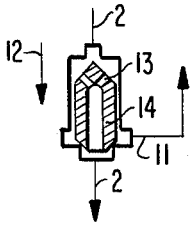
Figure 5:
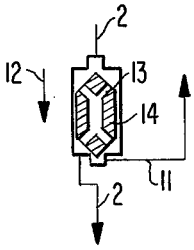

FIG. 4 is a schematic view, partly in cross section, through a modified embodiment of an injection installation in accordance with the present invention equipped with a flow-direction sensor in the valve body of a discharge valve and with a radial discharge into the oil leakage line; and FIG. 5 is a schematic view, partly in cross section, through an injection installation in accordance with the present invention similar to FIG. 4, with an axial discharge from the discharge valve into the oil leakage line.

Figure 1:
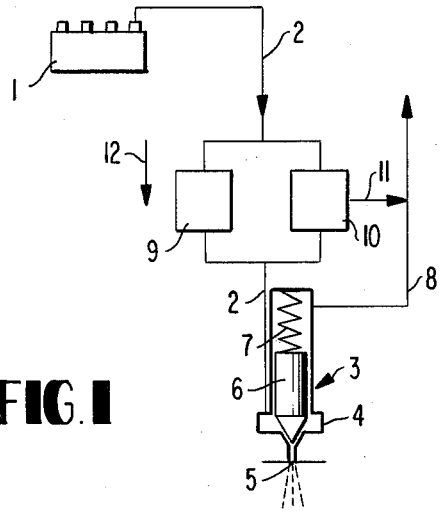
FIG. 1 is a schematic view of the over-all arrangement of the injection installation in accordance with the present invention.

Referring now to the drawing wherein like reference numerals are used throughout the various views to designate like parts, the injection installation illustrated in FIG. 1 consists of a conventional injection pump 1, by means of which fuel is fed to an injection valve generally designated by reference numeral 3 by way of injection lines 2. The injection valve 3 essentially consists of a valve housing 4 with a nozzle opening 5 and of a valve needle or pin 6 which is lifted off its valve seat, opening in the inward direction, by the fuel supplied under pressure by the injection pump 1 against the action of a compression spring 7 so that the fuel is discharged out of the injection valve 3 through the nozzle aperture 5. A leakage oil line 8 is connected to the valve housing 4 which conducts leakage oil either to the inlet side of the injection pump 1 or into a reservoir tank.

In order to avoid that the volume in fuel which is displaced at the end of each injection by the nozzle needle during its movement toward the valve seat, is sprayed off or discharged in part through the nozzle aperture 5 and is pumped back in part into the injection line 2, a conventional flow-direction sensor 9 and a discharge valve 10 are provided in the injection line 2 in proximity of the injection valve 3 and in a parallel arrangement to one another. The discharge valve 10 is connected with the leakage oil line 8 by way of a line 11.

The flow-direction sensor 9 permits fuel to flow unimpairedly in the injection line 2 in the direction of arrow 12, but blocks the injection line 2 when the pressure in the fuel between the injection valve 3 and the flow-direction sensor 9 is larger than in the injection line 2 between the flow-direction sensor 9 and the injection pump 1. The discharge valve 10 closes the injection line 2 and the line 11 during the injection operation. During the return flow of the fuel out of the injection valve 3, it enables a discharge through the line 11.

Figure 2:
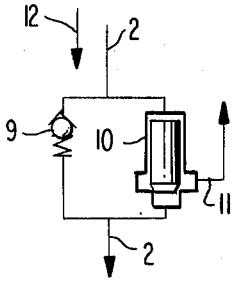
FIG. 2 is a schematic view of one embodiment of an injection installation in accordance with the present invention in which a sensor detecting the direction of flow is arranged in parallel with a discharge valve provided with a radial discharge into the oil leakage line.
Figure 3:
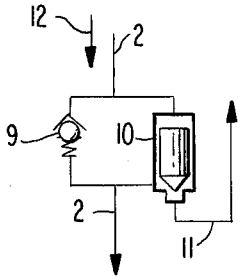
FIG. 3 is a schematic view of an injection installation according to the present invention, similar to FIG. 2, in which the discharge into the oil leakage line takes place in the axial direction of the discharge valve.

As can be seen from FIGS. 2 and 3, the flow-direction sensor 9 may be constructed as ball check-valve, and the discharge valve 10 may consist of a cylindrical valve body with a conical valve seat. The line 11 may be connected radially with the discharge valve 10 according to FIG. 2 and may be connected axially with the discharge valve 10 according to FIG. 3. Possibly, the valve bodies may also be stressed with compression springs. However, it is also possible to utilize a ball-shaped valve body for the discharge valve.

In the embodiments according to FIGS. 4 and 5, the flow-direction sensor forms together with the discharge valve a structural unit. The flow-direction sensor detecting the direction of flow is represented by throttle bores 13 in a valve body 14 forming the discharge valve. During the injection operation, the valve body 14 keeps the line 11 closed. Fuel under pressure passes through the throttle bores 13 and reaches through the valve body 14 the injection valve. Fuel flowing back after the termination of the injection operation lifts the valve body 14 so that the valve body 14 closes the injection line 2 at the feed line and opens the line 13. Possibly the valve body may also be constructed spring-loaded. It is additionally possible to represent the valve body as a ball and to form a throttling place by means of the gap between the ball and the valve housing. According to FIG. 4, the discharge into the line 11 takes place out of the structural unit in the radial direction whereas according to FIG. 5 it takes place in the axial direction.

In lieu of the throttle bores 11, also ball check-valves may be installed into the valve body 14.

Possibly, the injection valve 3 together with the flow-direction sensor 9 and the discharge valve 10 may also be constructed as a structural unit.

The fuel quantity controlled by the discharge valve 10 may be conducted also into a reservoir in lieu of into the leakage oil line 8 and may be subsequently conducted back to the injection line possibly throttled.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. An injection installation for a Diesel internal combustion engine which comprises an injection pump, injection valve means with valve needle means opening inwardly against a pressure of a spring means, injection lines communicating the injection pump with the injection valve means for delivering fuel from the injection pump to the injection valve means, and leakage oil line means extending from and in communication with the injection valve means, characterized in that an installation including a flow-direction sensor means and a discharge valve means is arranged in each injection line, said discharge valve means is in communication with the respective leakage oil line means and conducts a pump volume of the injection valve means resulting at the end of the injection operation into the respective leakage oil line means.

2. An installation according to claim 1, characterized in that the control means is arranged in proximity of the injection valve means.

3. An installation according to claim 1, characterized in that the flow-direction sensor means consists of a check valve opening in the direction toward the injection valve means.

4. An installation according to claim 1, characterized in that the flow-direction sensor means consists of a throttle means.

5. An installation according to claim 1, characterized in that the discharge valve means consists of a valve closing in the direction toward the injection pump and thereby opening in the direction to the leakage oil line means.

6. An installation according to claim 5, characterized in that the flow-direction sensor means and the discharge valve means are arranged parallel to one another.

7. An installation according to claim 5, characterized in that the flow-direction sensor means and the discharge valve means are combined into a structural unit.

8. An installation according to claim 7, with a check valve means as flow-direction sensor means, characterized in that the check valve means is arranged at the valve body of the discharge valve means.

9. An installation according to claim 7, with a check valve means as flow-direction sensor means, characterized in that the check valve means is arranged in the valve body of the discharge valve means.

10. An installation according to claim 7, with a throttle means as flow-direction sensor means, characterized in that the throttle means is provided at the valve body of the discharge valve means.

11. An installation according to claim 2, characterized in that the flow-direction sensor means consists of a check valve opening in the direction toward the injection valve means.

12. An installation according to claim 11, characterized in that the discharge valve means consists of a valve closing in the direction toward the injection pump and thereby opening in the direction to the leakage oil line means.

13. An installation according to claim 12, characterized in that the flow-direction sensor means and the discharge valve means are arranged parallel to one another.

14. An installation according to claim 2, characterized in that the flow-direction sensor means consists of a throttle means.

15. An installation according to claim 14, characterized in that the discharge valve means consist of a valve closing in the direction toward the injection pump and thereby opening in the direction to the leakage oil line means.

16. An installation according to claim 15, characterized in that the flow-direction sensor means and the discharge valve means are arranged parallel to one another.

17. An installation according to claim 15, characterized in that the flow-direction sensor means and the discharge valve means are combined into a structural unit.

18. An installation according to claim 1, with a check valve means as flow-direction sensor means, characterized in that the check valve means is arranged at the valve body of the discharge valve means.

19. An installation according to claim 1, with a check valve means as flow-direction sensor means, characterized in that the check valve means is arranged in the valve body of the discharge valve means.

20. An installation according to claim 1, with a throttle means as flow-direction sensor means, characterized in that the throttle means is provided at the valve body of the discharge valve means.

21. An injection arrangement for an internal combustion engine which includes an injection pump means, an injection valve means, an injection line arranged between the injection pump means and the injection valve means for supplying a volume of fuel from the injection pump means to the injection valve means, and a leakage line means communicating with the injection valve means, the improvement comprising: a flow-direction sensor means arranged in the injection line for permitting an unimpaired flow of fuel from the injection pump means to the injection valve means, and a discharge valve means arranged in the injection line and communicating with the leakage line means for conducting a volume of fuel of the injection valve means resulting at an end of an injection operation into the leakage line means.

22. An arrangement according to claim 21, wherein said flow direction sensor means and said discharge valve means are arranged parallel to one another in the injection line.

23. An arrangement according to claim 21, wherein said flow direction sensor means is constructed as a ball-check valve.

24. An arrangement according to claim 23, wherein said discharge valve means includes a cylindrical valve housing, and a cylindrical valve body disposed in said valve housing for selectively communicating an interior of the valve housing with the injection nozzle means and the leakage line means.

25. An arrangement according to claim 24, wherein a line means is arranged at a radial position of the cylindrical valve housing for communicating the interior of the valve housing with said leakage line means.

26. An arrangement according to claim 25, wherein the injection line means opens into the interior of an end of the cylindrical valve housing, and wherein the cylindrical valve body includes a conical valve seat cooperating with the opening at the valve housing means, said valve body and said conical valve seat closing the opening at the valve housing and line means to the leakage line means during an injection operation.

27. An arrangement according to claim 21, wherein said discharge valve means includes a valve housing, a valve body disposed in said valve housing, and a longitudinally extending bore means provided in said valve body, and wherein said flow direction sensor means includes at least one throttle bore means provided in said valve body communicating with said longitudinal bore means.

28. An arrangement according to claim 27, wherein a line means is provided for communicating an interior of the valve housing with the leakage line means, said line means opening at a radial position of the valve housing, said valve body cooperating with the opening of said line means to close the line means during an injection operation.

* * * * *